US005209150A

United States Patent [19]

Arconada Arconada

[11] Patent Number: 5,209,150

[45] Date of Patent: May 11, 1993

[54] SHARPENING DEVICE FOR COLD CUTS CUTTING MACHINES

[76] Inventor: Luis Arconada Arconada, Avda. Sancho El Sabio, 26 - 1° C, San Sebastian, Spain, 20010

[21] Appl. No.: 805,490

[22] Filed: Dec. 9, 1991

[30] Foreign Application Priority Data

Mar. 11, 1991 [ES] Spain ..... 9100739

[51] Int. Cl.[5] ..... B26D 7/12

[52] U.S. Cl. ..... 83/174; 76/85; 83/676; 51/288

[58] Field of Search ..... 83/174.1, 174, 676, 83/331; 76/85; 51/288

[56] References Cited

U.S. PATENT DOCUMENTS

| | | | |
|---|---|---|---|
| 1,977,067 | 10/1934 | Johnston | 83/174.1 |
| 1,978,929 | 10/1934 | Breaden | 83/174.1 |
| 2,476,177 | 7/1949 | Bloom et al. | 83/174.1 |
| 3,704,736 | 5/1972 | Pratley | 83/397 |
| 3,820,289 | 6/1974 | Good | 83/174.1 X |
| 3,986,307 | 10/1976 | Shie, III | 83/174.1 X |
| 4,263,754 | 4/1981 | DeTorre | 76/85 X |
| 4,503,643 | 3/1985 | Johnson et al. | 83/174.1 X |
| 5,090,281 | 2/1992 | Paulson et al. | 83/174 X |

FOREIGN PATENT DOCUMENTS

| | | |
|---|---|---|
| 115785 | 8/1984 | European Pat. Off. . |
| 3214464 | 4/1982 | Fed. Rep. of Germany . |
| 7901597 | 1/1979 | France . |
| 327331 | 4/1930 | United Kingdom . |
| 941031 | 11/1963 | United Kingdom . |

*Primary Examiner*—Frank T. Yost
*Assistant Examiner*—Kenneth E. Peterson
*Attorney, Agent, or Firm*—Darby & Darby

[57] ABSTRACT

It is placed in a stationary manner in the top part of the machine and has a sharpening wheel (18) as well as a polishing device of the blade that eliminates the rough edges produced in sharpening.

It has a frame (1) that incorporates a cover (3) that is subject to being collapsed in order to allow the unit to be cleaned. In the bottom the cover (3) incorporates a support fastened by means of a body (9) which is passed through by a central hole through which a shaft (12) passes whose top end incorporates a control (13) and in the bottom thereof the sharpening wheel (18) the shaft (12) being aided by a spring (14) whereby upon turning the control (13) the movement of the sharpening wheel (18) is produced until it makes contact with the cutting blade (2.) Upon releasing the control (13) the sharpening wheel returns to its original position, the cutting blade (2) remaining protected in the entire process.

In order to turn the control (13) it is necessary to push the same which releases two retaining notches which prevent it from turning in the inoperative state.

The blade polishing device consists of a strip solid to the end of a shaft (23) which remains mounted in a recess provided in the support (8); the other end of the shaft (23) incorporates a latch which makes movement of the shaft (23) possible against a spring (26) the polishing strip (25) positioning itself in the edge of the cutting blade (2.)

6 Claims, 5 Drawing Sheets

A

FIG. 6
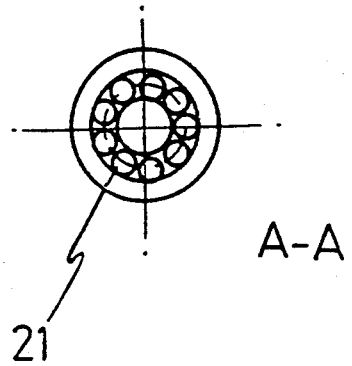
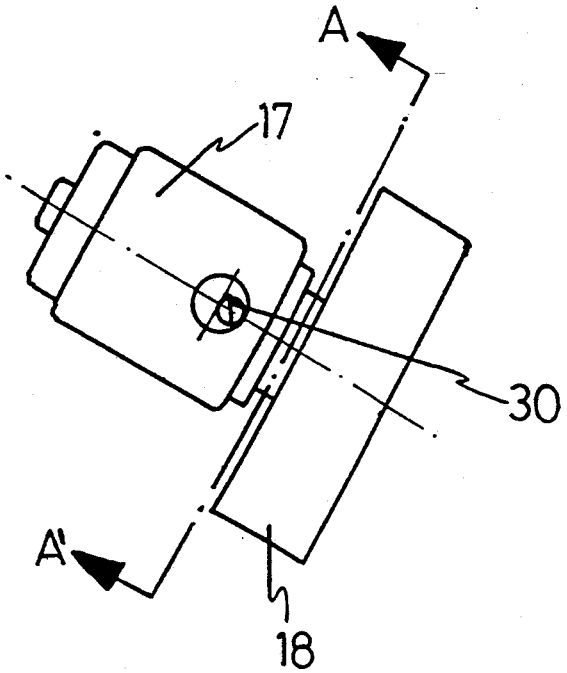
FIG. 5

SHARPENING DEVICE FOR COLD CUTS CUTTING MACHINES

OBJECT OF THE INVENTION

As is expressed in the title of this specification, the present invention consists of a sharpening device for cold cuts cutting machines that is placed in a stationary manner in the top part of the machine and that has a sharpening wheel as well as a polishing device of the blade, which eliminates the rough edges that have been produced in the sharpening operation; the object being to protect the cutting blade at all times, even when the sharpening and polishing operation takes place for which purpose the sharpening is done by means of a slight turn of the sharpening wheel and the polishing is done by means of movement of a strip, the blade being protected at all times.

BACKGROUND OF THE INVENTION

In cold cuts cutting machines it is necessary to periodically sharpen the cutting blade.

Conventionally sharpening devices which basically consist of a sharpening wheel and also another wheel which effects the polishing of the blade, eliminating the rough edges that have been produced in the sharpening operation, are known.

Conventionally these sharpening elements are placed in cold cuts cutting machines in different ways.

Thus, placement of these elements in the carriage of the machine or also in the bar of the counterweight thereof is known.

In both cases the wheels are incorporated in the machine when the sharpening operation is necessary and this creates an inconvenience given that it is necessary to mount and dismount the same, each time that it is desired to sharpen the blade, also causing a possible loss of parts, since these must be duly stored, which does not happen many times.

Presently, besides the safety regulations require that the counterweight must remain mounted permanently without the possibility of dismounting, therefore, it is not possible to place the sharpening elements in this place.

Likewise, there are other sharpening systems, in which the sharpening and polishing wheels are incorporated in a head generally placed in the top part of the machine close to the cutting blade.

In these systems, in order to be able to effect the sharpening operations, it is necessary to move upward the above cited head in order to be able to subsequently turn the sharpening elements 180 degrees in order to position them in contact with the cutting blades.

The above cited operations in order to permit the specific functions to be carried out cause the cutting blade to remain, in a given moment, unprotected when the head is raised, with the subsequent risk that this lack of protection entails.

Besides, the polishing wheels provide the premature wear and tear of the cutting blade.

DESCRIPTION OF THE INVENTION

In order to solve the above cited inconveniences, the invention consists of a sharpening device for cold cuts cutting machines that is put in a stationary and permanent manner in the top part of the cutting machine and at the top part of the blade that the machine incorporates.

The device of the invention has a frame which is fastened to the unit of the cutting machine by the top part of the cutting blade and incorporates a cover which is subject to tilting with regard to the frame through a rotation shaft placed in the top part of the frame.

At the bottom the cover has a support piece which is fastened to the cover by a body placed in the top part of said cover, this fastening being done by screws and inserts.

In the center the body has a through hole which is passed through by a shaft to which a control has been fastened at the top and a support at the bottom in which a bushing that fastens the sharpening wheel through a rotating shaft is housed.

Over said body (9) there is a spring one of whose ends remains located in the body itself and the other in the control, in such a way that the spring acts by torsion and by compression.

Thus, when it is not necessary to effect the sharpening of the blade, the sharpening wheel is moved with regard to the cutting blade, thus in order to sharpen the blade the control is pushed and turned overcoming the action of the spring, until the sharpening wheel comes in contact with the blade, thus producing the sharpening of the same. The pressure is adjusted by the other spring.

Upon no longer operating the control, the sharpening wheel returns to its original position by means of the action of the spring.

In the sharpening operation the frame is always in its stationary position, therefore the cutting blade is constantly protected.

The support fastened to the cover by means of the above cited body houses a shaft wherein there is a strip fixed which eliminates the rough edges that are produced in the sharpening of the blade.

For this purpose the shaft has a latch in such a way that it can effect the movement of said shaft against a spring which aids the shaft, thus the polishing strip is positioned on the edge of the cutting blade, thus eliminating the rough edges that have been produced in sharpening.

The fact that the cover can pivot around a shaft makes it possible to clean the device of the invention.

Hereinafter in order to provide a better understanding of this specification and forming an integral part thereof, a series of figures are attached wherein with an illustrative and non-restrictive manner the object of the invention has been represented.

BRIEF DESCRIPTION OF THE FIGURES

FIG. 5 is a elevational view of the sharpening wheel 18 and its support 17 useful in explaining the operation of piston 30.

FIG. 6 is a sectional view taken along the line A—A' in FIG. 5 and looking in the direction of the arrows.

DESCRIPTION OF AN EMBODIMENT OF THE INVENTION

Figure 1:
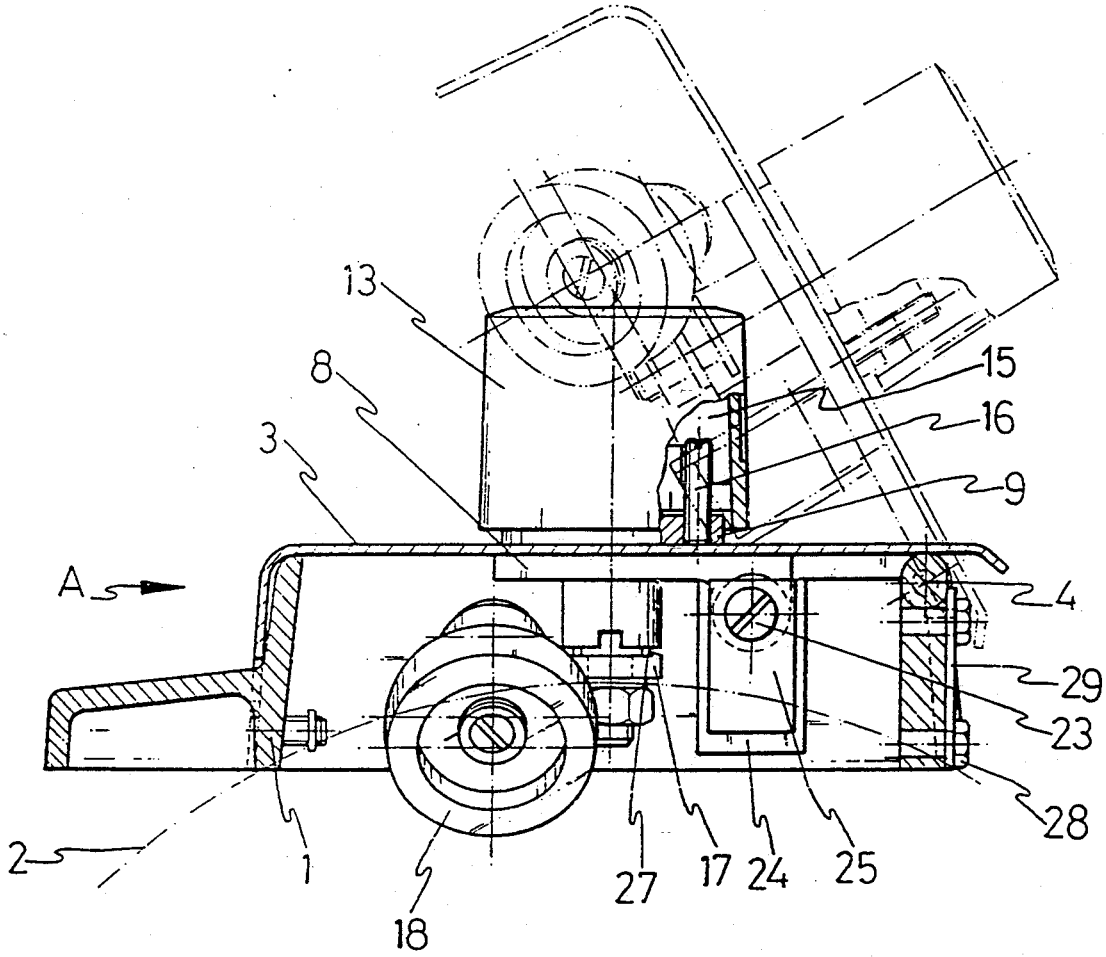
FIG. 1. It shows a longitudinally sectioned view of the device object of the invention, where the control is partially sectioned; and by means of a dash and dotted line one sees the collapsing of the cover in order to enable the sharpener to be cleaned.
Figure 2:
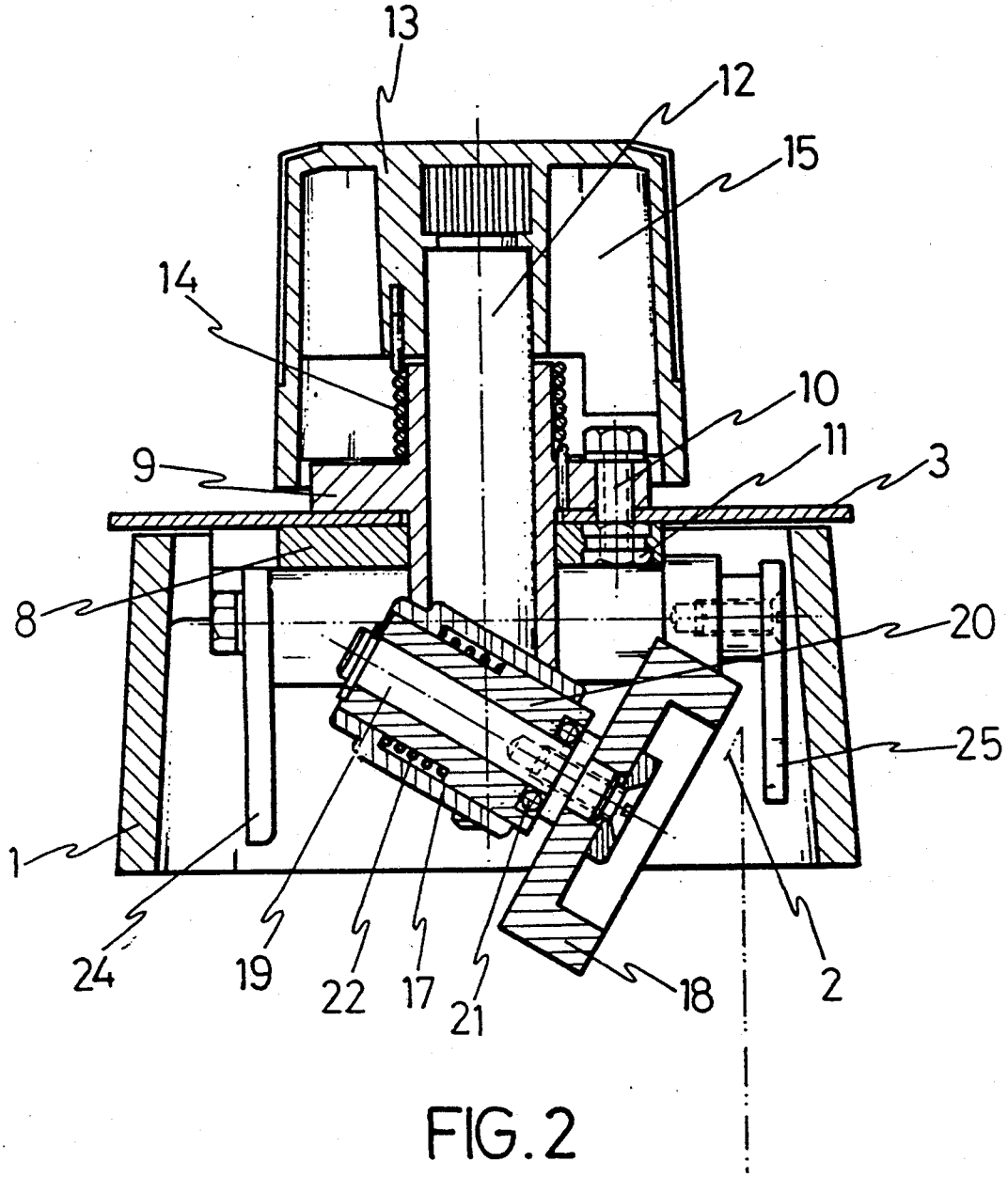
FIG. 2. It shows a transversally sectioned view of the sharpening device object of the invention.
Figure 3:
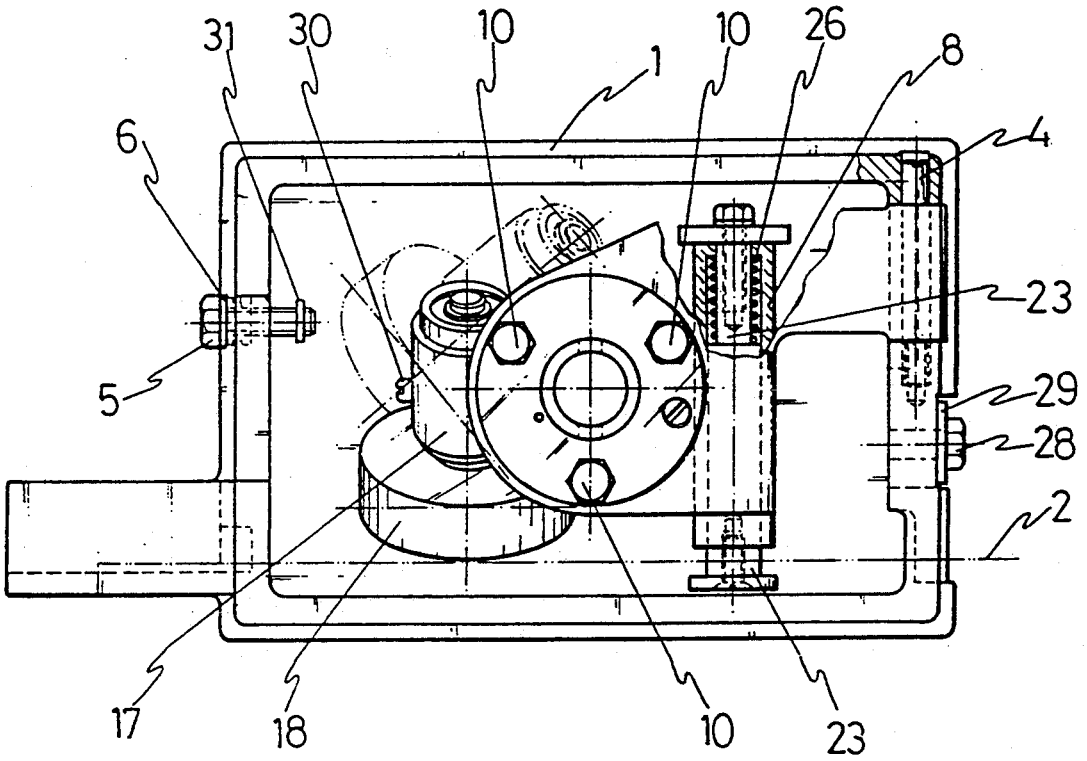
FIG. 3. It shows a partially sectioned bottom view representing by a dash and dotted line the movement of the sharpening wheel.
Figure 4:
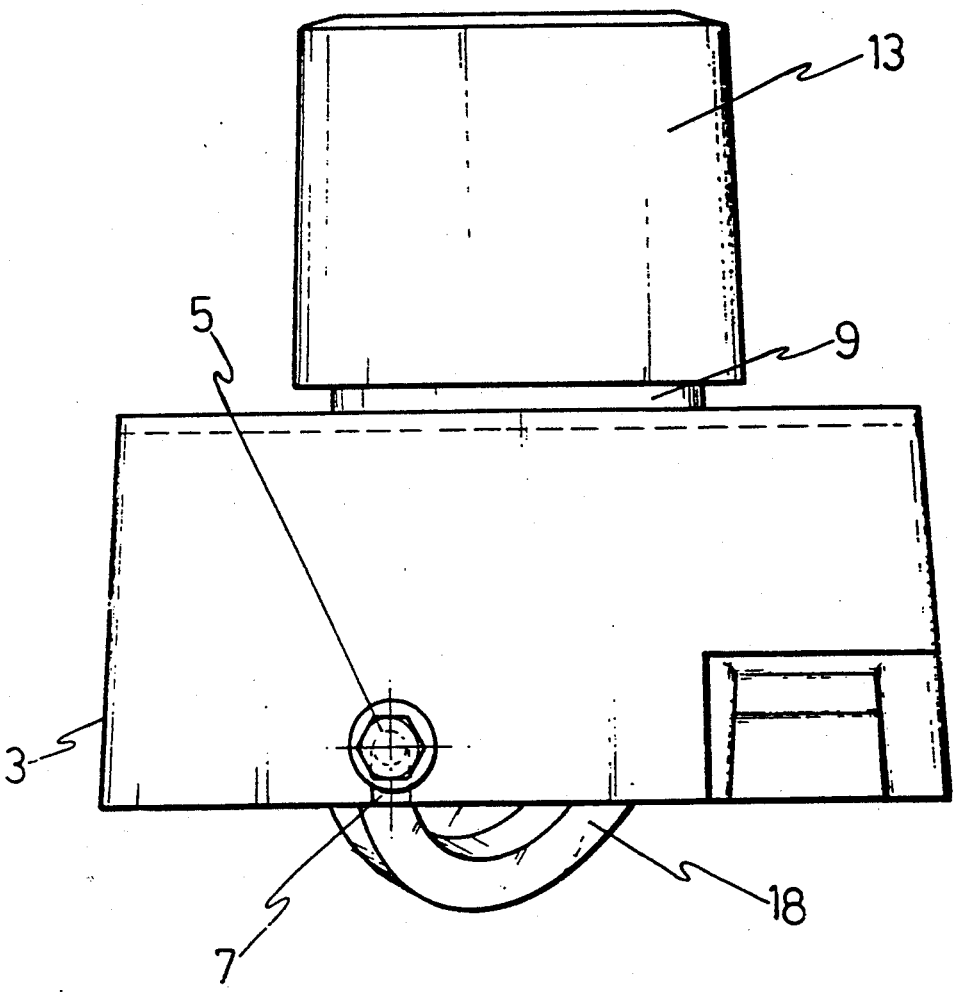
FIG. 4. It shows a side view of the device object of the invention from said A represented in FIG. 1.

Hereinafter a description is made of the invention based on the above cited figures.

Thus, the invention consists of a sharpening device for cold cuts cutting machines that comprises a frame (1) that is fastened by screws (28) and the flange (29) permanently to the unit of the cutting machine at the top part of the cutting blade (2), which in the drawings has been represented by the dash and dotted line.

The frame (1) incorporates a cover (3) that remains retained by a rotation shaft 4, in such a way that the cover (3) is capable of tilting around said shaft (4) that remains situated in the top part of the frame(1.)

The cover (3) incorporates all the elements that make up the device itself. Thus, the cover (3) has in its inner part a support piece (8) that is fastened to cover (3) by means of a body (9) located in the top part of said cover (3), this fastening being done by screws (10) and inserts (11.)

Body (9) has a center hole through which shaft (12) crosses in whose top end there is a control (13) joined thereto.

Over body (9) there is a spring (14) one of whose ends remains retained in a hole made in the body (9), while the other end remains retained in a hole made in the control (13), whereby the springs acts by torsion and by compression.

The sharpening wheel (18) is fastened by a shaft (19) that remains mounted in a rotating manner in a bushing (20) that has a housing for steel balls (21) and which in turn is housed in a support (17) which has another housing for spring (22) and a lug for fastening to the shaft (12.)

The lug of the support (17) has a notch (27) that remains located in another notch provided in body (9), in such a way that it prevents the rotation of the shaft (12) by means of the control (13.)

In the position in which both notches are retained the sharpening wheel (18) is displaced with regard to the cutting blade (2) and therefore, when it is desired to sharpen the blade (2) the control (13) must be pushed and turned so that said sharpening wheel (18) contacts the cutting blade (2) in order to produce the sharpening of the same.

In order to be able to turn against the spring (14) it is necessary to push the control (13) in such a way that the notch (27) situated in the lug of the support (17) remains freed from the notch provided in the body (9) which makes it possible to turn the control (13) until the sharpening wheel (18) comes into contact with the cutting blade (2); the pressure is adjusted by the compression of the spring (22.)

The inside of the control (13) includes some ribs or walls (15) which, in the rotation of the control, carry out stopping functions against a threaded stem (16) which is integral with the body (9.)

Therefore, the rotation stop position are determined by the ribs (15) of the control (13) which act as the stop in the threaded stem (16), but obviously, before this stop is carried out, the contact is produced of the sharpening wheel (18) with the cutting blade (2), in such a way that these stops carry out safety functions.

Once one stops operating the control (13), it returns to its initial position by action of the spring (14), the notch (27) situated in the lug of the support (17) remains introduced in the notch provided in the body (9.)

Just as is inferred from the description made, in the sharpening operation the frame (1) is always located in its stationary position therefore said frame (1) is constantly protecting the cutting blade (2.)

The body (8) has a housing in which there is mounted a shaft (23) in one of whose ends there is a strip (25) integrally mounted.

The other end of the shaft (23) includes a latch (24) in such a way that it makes it possible to effect movement of the shaft (23) against a spring (26) that aids the shaft (23), in such a way that the polishing strip (25) is positioned on the edge of the cutting blade (2.)

The polishing device cannot turn due to the arrangement of the latch (24) with regard to the support (8.)

Therefore, upon operating the latch (24) it becomes possible to carry out polishing of the cutting blade, eliminating the possible rough edges that have been produced upon carrying out the sharpening of said butting blade (2.)

The sharpening wheel (18) remains mounted by means of a bushing (20), some steel balls (21), a spring (22) and the shaft (19), where the sharpening wheel (18) is located so that when said sharpening wheel (18) is in contact with the cutting blade (2), the rotation of the cutting blade determines, also the rotation of the sharpening wheel (18.)

Besides, it should be pointed out that the support has a hole through which a piston (30) which is threaded to the bushing (20) passes, in order to prevent said bushing (20) from rotating.

The piston (30) has a diameter smaller than the one of the hole of the support (17), in such a way that it permits axial displacement of the sharpening wheel (18) upon contacting with the blade (2) and at the same time it restricts said displacement.

In this way, by means of the invention it becomes possible to have a sharpening device for cold cuts cutting machines that remains mounted in a stationary manner on the cutting machine and which protects the blade at all times, even in the sharpening operation.

On the other hand, by means of the strip (25) the possibility of premature wear of the cutting blade is avoided as the sharpening wheels conventionally used for this purpose are replaced.

As it has been indicated above, the invention also has a cover (3) which can tilt around the rotation shaft (4) for which purpose the cover (3) remains securely in the collapsed position by means of screw (5) and washer (6) which are situated over the corresponding screw which passes through the cover (3) through a groove (7) situated in one of the walls of the cover (3), therefore, loosening the screw (5) makes it possible to collapse the cover (3) around the rotation shaft (4), which makes it easy to clean the device of the invention.

In order to prevent the screw (5) and the washer (6) from becoming lost, a retention washer (31) is placed on the end of the screw (5.)

The device of the invention is fastened to the cutting machine by means of a flange (29) and some screws (28.)

I claim:

1. A sharpening device for a cold cuts cutting machine, said cutting machine having a cutting blade, said sharpening device comprising:

A frame mounted to said device;

a cover mounted on said frame;

a first support mounted to said cover, said first support having a cylindrical body penetrating said cover in a vertical direction, said first support having a center hole;

a first shaft within said cylindrical body, said first shaft having a control end and a support end;

means for spring mounting a sharpening wheel to said support end, said means for spring mounting mounted on said support end;

a sharpening wheel rotatably mounted to said means for spring mounting;

spring means mounted on said control end;

said sharpening wheel positioned such that upon rotation of said control end, said sharpening wheel will be brought into contact with said cutting blade, and upon releasing said control end, said spring means will cause said sharpening wheel to disengage from said cutting blade, said cutting blade being under said cover.

2. A sharpening device as in claim 1, further comprising a means for polishing said cutting blade, said means for polishing comprising:

a polishing support mounted to said first support;

a second shaft slidably mounted within said polishing support, said second shaft having a control end and a support end;

a polishing strip mounted onto said support end of said second shaft;

a second spring means mounted to said second shaft such that when said control end of said second shaft is moved, said polishing strip will contact said cutting blade, and upon releasing said control end, said second spring means will cause said polishing strip to disengage from said cutting blade.

3. A sharpening device as in claim 2, wherein said cover is pivotably mounted to said frame to provide access to said sharpening wheel and said polishing strip when in an open position, said device further comprising means for releasably locking said cover to said frame to prevent pivoting of said cover to said open position.

4. A sharpening device as in claim 3, further comprising a controller mounted to said control end of said first shaft and a stem connected to said first support, said controller having at least one internal rib positioned such that rotation of said controller is limited by the abutment of said rib and said stem.

5. A sharpening device as in claim 4, wherein said means for spring mounting comprises a third shaft within a housing, said sharpening wheel mounted to said third shaft, a spring within said housing for biasing said shaft axially toward said cutting blade, and a spring mount support mounted to said first shaft, said spring mount support having a first notch, said cylindrical body having a complementary second notch, said first shaft being rotatable within said cylindrical body only when said first notch is disengaged from said second notch.

6. A sharpening device as in claim 5, wherein said means for spring mounting further comprises a piston extending through a hole in said housing, and a bushing mounted around said third shaft within said housing, said piston connected to said bushing such that said bushing is prevented from rotation and axial movement of said bushing is limited.

* * * * *

UNITED STATES PATENT AND TRADEMARK OFFICE

CERTIFICATE OF CORRECTION

PATENT NO. : 5,209,150

DATED : May 11, 1993

INVENTOR(S) : Luis Arconada Arconada

It is certified that error appears in the above-indentified patent and that said Letters Patent is hereby corrected as shown below:

On the title page, Item [30] Foreign Application Priority Data should read --Dec. 18,1990 [ES] Spain .....9003237--.

Signed and Sealed this

Twelfth Day of July, 1994

Bruce Lehman

*Attest:*

BRUCE LEHMAN

*Attesting Officer*

*Commissioner of Patents and Trademarks*